US012601521B2

(12) United States Patent
Wu et al.

(10) Patent No.: US 12,601,521 B2
(45) Date of Patent: Apr. 14, 2026

(54) AIR CONDITIONING AND VENTILATING DEVICE

(71) Applicant: DELTA ELECTRONICS, INC., Taoyuan City (TW)

(72) Inventors: Jian-Jhang Wu, Taoyuan City (TW); Shih-Kai Lin, Taoyuan City (TW)

(73) Assignee: DELTA ELECTRONICS, INC., Taoyuan City (TW)

( * ) Notice: Subject to any disclaimer, the term of this patent is extended or adjusted under 35 U.S.C. 154(b) by 289 days.

(21) Appl. No.: 18/207,139

(22) Filed: Jun. 8, 2023

(65) Prior Publication Data

US 2024/0310073 A1 Sep. 19, 2024

(30) Foreign Application Priority Data

Mar. 16, 2023 (CN) ..... 202310255321.5

(51) Int. Cl.
*F24F 13/20* (2006.01)

(52) U.S. Cl.
CPC ..... *F24F 13/20* (2013.01); *F24F 2013/205* (2013.01)

(58) Field of Classification Search
CPC ..... F24F 13/20; F24F 2013/205; F24F 1/028; F24F 1/0018; F24F 1/0033; F24F 1/0284;
(Continued)

(56) References Cited

U.S. PATENT DOCUMENTS 4,027,498 A * 6/1977 Fessler ..... F24F 1/0323 62/263
5,657,641 A * 8/1997 Cunningham ..... H05K 7/20681 62/263
(Continued)

FOREIGN PATENT DOCUMENTS

CN 203708732 U * 7/2014
CN 212585083 U * 2/2021
JP 3075274 B2 * 8/2000

OTHER PUBLICATIONS

Yabu, Tomohiro, JP2000154948 Translation.pdf, "Cooler", Jun. 2000, pp. 1-10.*
(Continued)

*Primary Examiner* — Avinash A Savani
*Assistant Examiner* — Ryan L Faulkner
(74) *Attorney, Agent, or Firm* — HDLS IPR SERVICES; Chun-Ming Shih

(57) ABSTRACT

This disclosure is related to an air conditioning and ventilating device. An air conditioning unit, a first ventilation fan set, an inner air-conditioning fan and an outer air-conditioning fan are disposed in a cabinet. The cabinet includes a cabinet body and a partition. The cabinet body is separated into an inner chamber and an outer chamber. The cabinet body includes an inner ventilation inlet, an inner air-conditioning inlet, an inner air-conditioning outlet and an inner ventilation outlet communicating with the inner chamber. The cabinet body includes an outer air outlet and an outer air-conditioning inlet communicating with the outer chamber. The first ventilation fan set communicates with the inner ventilation inlet and the outer air outlet. The inner air-conditioning fan communicates with the inner air-conditioning inlet and the inner air-conditioning outlet. The outer air-conditioning fan communicates with the outer air-conditioning inlet and the outer air outlet.

9 Claims, 7 Drawing Sheets

(58) Field of Classification Search
CPC .. F24F 1/0287; F24F 1/029; F24F 7/06; F24F 13/28; F24F 8/108; F24F 13/085; H05K 7/186; H05K 7/20; H05K 7/20536; H05K 9/0062; H05K 7/20154; H05K 7/2039; H05K 7/20909; H05K 7/20572; H05K 7/207
USPC ..... 454/252
See application file for complete search history.

(56) References Cited

U.S. PATENT DOCUMENTS

| | | | | |
|---|---|---|---|---|
| 2011/0198061 | A1* | 8/2011 | Chen | F28F 7/02 165/104.34 |
| 2020/0064008 | A1* | 2/2020 | Matambo | F24F 11/0001 |
| 2022/0099311 | A1* | 3/2022 | Kim | F24F 1/0284 |
| 2024/0349463 | A1* | 10/2024 | Qiu | H05K 7/20318 |

OTHER PUBLICATIONS

Cheng, Hongli, CN212585083 Translation.pdf, "Cabinet air conditioner easy to produce and assemble", Feb. 2021, pp. 1-16.*
Zeng, Guohui, CN203708732 Translation.pdf, "Air conditioner for equipment cabinet and equipment cabinet", Jul. 2014, p. 1-.*

* cited by examiner

AIR CONDITIONING AND VENTILATING DEVICE

BACKGROUND OF THE DISCLOSURE

Technical Field

This disclosure relates to an air conditioning device, and more particularly relates to an air conditioning and ventilating device for communication equipment.

Description of Related Art

With the development of communication system technology, the device with faster transmission rate may generate higher heat. Thus, how to take an effective measure of heat dissipation for communication equipment to improve the performance of cooling and to achieve the effect of energy saving is the target of the industry.

Moreover, the heat dissipation device of communication equipment in the related art includes heat exchangers and heat dissipation fans. The heat exchanger includes an internal circulation air channel and an external circulation air channel. The heat dissipation fan includes an external circulation fan communicating with the external air and an internal circulation fan communicating with the cabinet. Additionally, the forced air flow under the operation of the external circulation fan and the internal circulation fan passes through the heat exchanger to perform heat exchange and dissipate heat of the cabinet effectively.

Furthermore, in the heat dissipation device of the communication equipment of the related art, the airflow of the internal circulation fan flows to ventilation channel and circulation channel between the cabinet and the outside. However, the airflow of the internal circulation fan flows to the ventilation channel and circulation channel at the same time may cause a bypass airflow. As a result, the hot air may not be dissipated effectively.

In view of the above drawbacks, the inventor proposes this disclosure based on his expert knowledge and elaborate researches in order to solve the problems of related art.

SUMMARY OF THE DISCLOSURE

One object of this disclosure is to provide an air conditioning and ventilating device, in which a first ventilation fan set and an inner air-conditioning fan are disposed in the cabinet. Thus, the airflow passes through the first ventilation fan set when performs the operation of ventilation, and the airflow passes through the inner air-conditioning fan when performs the operation of air conditioning. As a result, the bypass airflow may be avoided, and the purpose of heat dissipation of the cabinet effectively is achieved.

One object of this disclosure is to provide an air conditioning and ventilating device, in which the cabinet body includes an outer air outlet communicating with the outer chamber to provide a common air outlet of heat dissipation for the operation of air conditioning unit and the first ventilation fan set.

This disclosure is an air conditioning and ventilating device including a cabinet, an air conditioning unit, a first ventilation fan set, an inner air-conditioning fan and an outer air-conditioning fan. The cabinet includes a cabinet body and a partition. The cabinet body has an accommodating space. The partition separates the accommodating space into an inner chamber and an outer chamber. The cabinet body includes an inner ventilation inlet, an inner air-conditioning inlet, an inner air-conditioning outlet and an inner ventilation outlet communicating with the inner chamber. The cabinet body includes an outer air outlet and an outer air-conditioning inlet communicating with the outer chamber. The air conditioning unit is installed in the cabinet body. The first ventilation fan set is arranged in the accommodating space and communicates with the inner ventilation inlet and the outer air outlet. The inner air-conditioning fan is arranged in the inner chamber and communicates with the inner air-conditioning inlet and the inner air-conditioning outlet. The outer air-conditioning fan is arranged in the outer chamber and communicates with the outer air-conditioning inlet and the outer air outlet.

In comparison with the related art, a first ventilation fan set and an inner air-conditioning fan are disposed in the cabinet of the air conditioning and ventilating device of this disclosure, so that the airflow passes through the first ventilation fan set during the operation of ventilation, and the airflow passes through the inner air-conditioning fan during the operation of air conditioning to avoid the airflow bypass. Thus, the purpose of effective heat dissipation for the cabinet is achieved. Furthermore, when using the air-conditioning and ventilating device of this disclosure, if the temperature of the specific area reaches a certain value, the first ventilation fan set of the air-conditioning and ventilating device is running to ventilate the specific area. Additionally, during the operation of ventilation, the air conditioning unit is not running, and the air conditioning and ventilating device may achieve the effect of saving energy.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
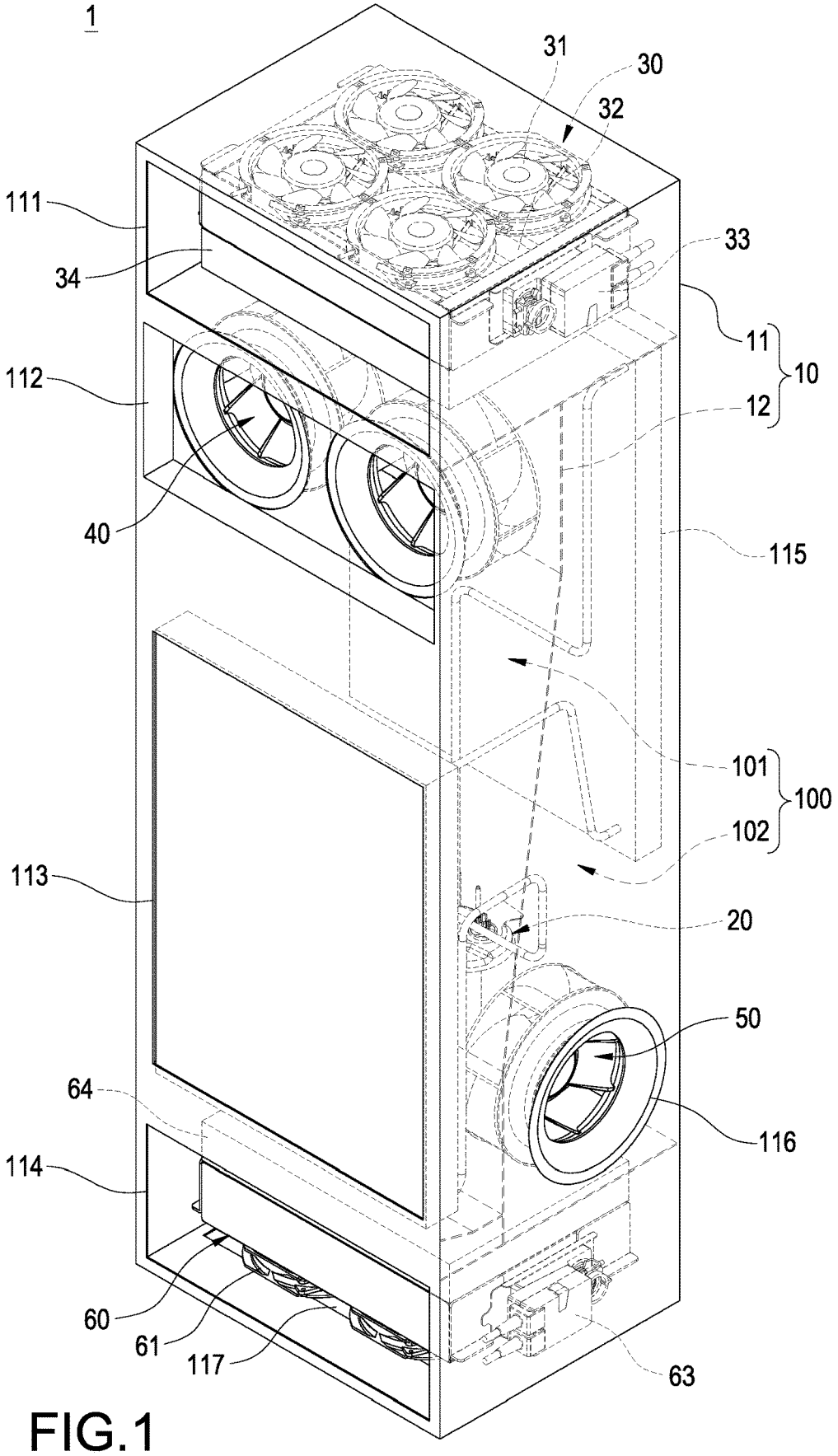
FIG. 1 to FIG. 3 are perspective schematic views of the air conditioning and ventilating device in this disclosure.
Figure 2:
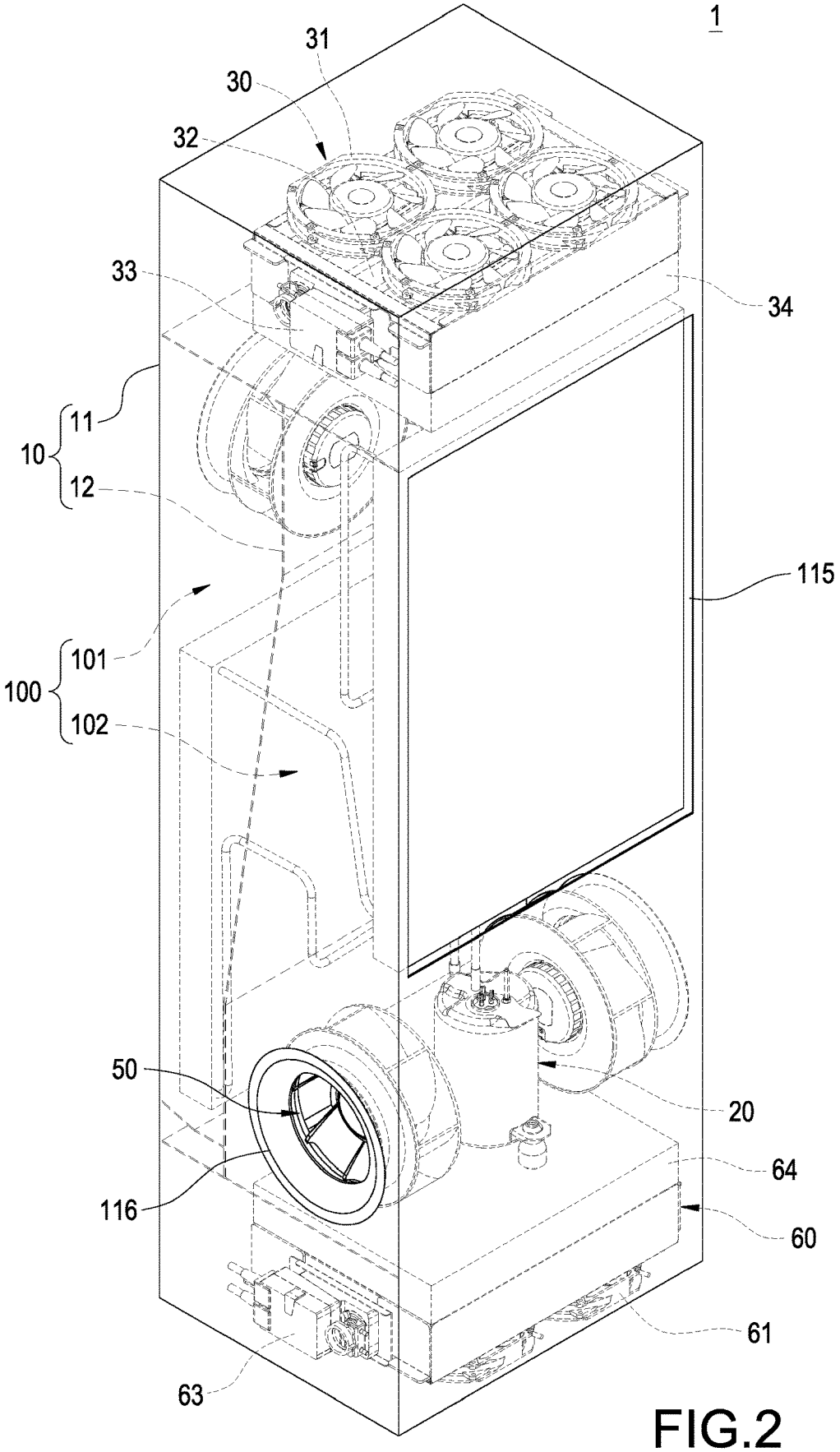
Figure 3:
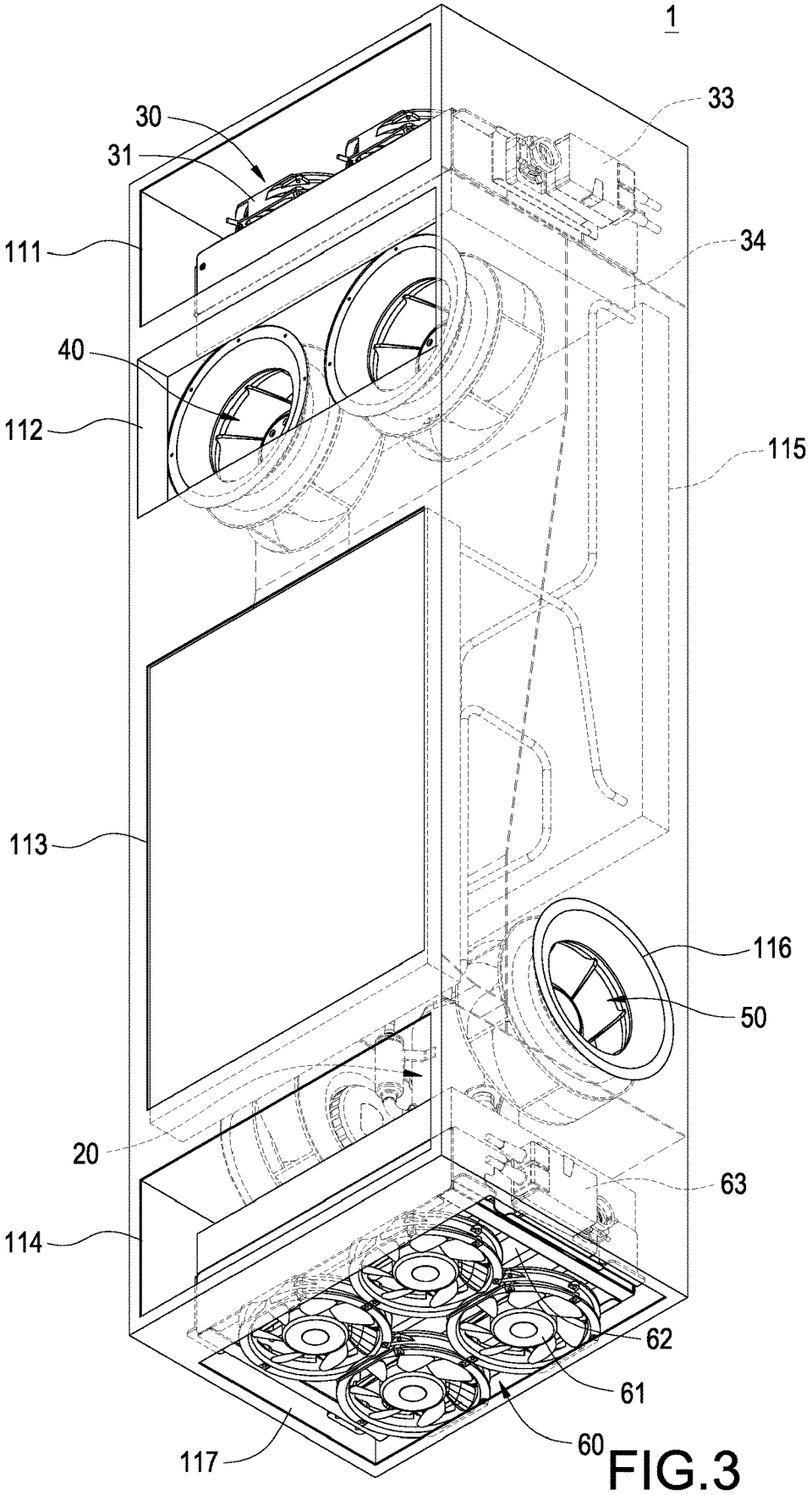

Please refer to FIG. 1 to FIG. 3, which are perspective schematic views of the air conditioning and ventilating device 1 in this disclosure. This disclosure provides an air conditioning and ventilating device 1 including a cabinet 10, an air conditioning unit 20, a first ventilation fan set 30, an inner air-conditioning fan 40 and an outer air-conditioning fan 50. The air conditioning unit 20, the inner air-conditioning fan 40 and the outer air-conditioning fan 50 are disposed in the cabinet 10. The air conditioning and ventilating device 1 generates cooling air through the operation of the air conditioning unit 20, and generates a forced airflow to dissipate heat in a specific area through the inner air-conditioning fan 40 and the outer air-conditioning fan 50. Additionally, the first ventilation fan set 30 is arranged on the top of the cabinet 10 and communicates with the external environment. After the temperature in the specific area reaches a certain value, the air conditioning and ventilating device 1 may start the operation of the first ventilation fan set 30 in the specific area, so as to achieve the effect of energy saving. More detailed description of the air conditioning and ventilating device 1 is as follows.

The cabinet 10 includes a cabinet body 11 and a partition 12. The cabinet body 11 has an accommodating space 100. The partition 12 separates the accommodating space 100 into an inner chamber 101 and an outer chamber 102. The cabinet body 11 includes an inner ventilation inlet 111, an inner air-conditioning inlet 112, an inner air-conditioning outlet 113 and an inner ventilation outlet 114 all communicating with the inner chamber 101. Additionally, the cabinet body 11 also includes an outer air outlet 115 and an outer air-conditioning inlet 116 both communicating with the outer chamber 102.

The air conditioning unit 20 is installed in the accommodating space 100. The air conditioning unit 20 includes components such as a compressor, an evaporator, and a condenser (not shown in figures). In some embodiments, the location of the air conditioning unit 20 is not limited, and may be adjusted according to actual conditions.

The first ventilation fan set 30 is arranged in the accommodating space 100 and communicates with the inner ventilation inlet 111 and the outer air outlet 115. Furthermore, the inner air-conditioning fan 40 is disposed in the inner chamber 101 and communicates with the inner air-conditioning inlet 112 and the inner air-conditioning outlet 113. Moreover, the outer air-conditioning fan 50 is disposed in the outer chamber 102 and communicates with the outer air outlet 115 and the outer air-conditioning inlet 116. It should be noted that the outer air outlet 115 is a common air outlet for the air-conditioning unit 20 and the first ventilation fan set 30 during the operation. That is, the outer air outlet 115 is an outlet of heat dissipation for both the operation of air conditioning and the operation of ventilation.

Specifically, the first ventilation fan set 30 and the inner ventilation inlet 111 are disposed on the top of the cabinet body 11. The inner air-conditioning fan 40 is located below the first ventilation fan set 30. The inner air-conditioning inlet 112 is disposed below the inner ventilation inlet 111. Additionally, the inner air-conditioning outlet 113 is arranged between the inner air-conditioning inlet 112 and the inner ventilation outlet 114. The outer air-conditioning inlet 116 is arranged between the inner ventilation outlet 114 and the inner air-conditioning outlet 113.

In this embodiment, the air conditioning and ventilating device 1 further includes a second ventilation fan set 60. Furthermore, the cabinet body 11 includes an outer ventilation inlet 117 communicating with the outer chamber 102. The second ventilation fan set 60 is arranged on the bottom of the cabinet body 11. Moreover, the outer ventilation inlet 117 and the inner ventilation outlet 114 are arranged on two sides of the bottom of the cabinet body 11. The outer air-conditioning fan 50 is located above the second ventilation fan set 60.

Figure 4:
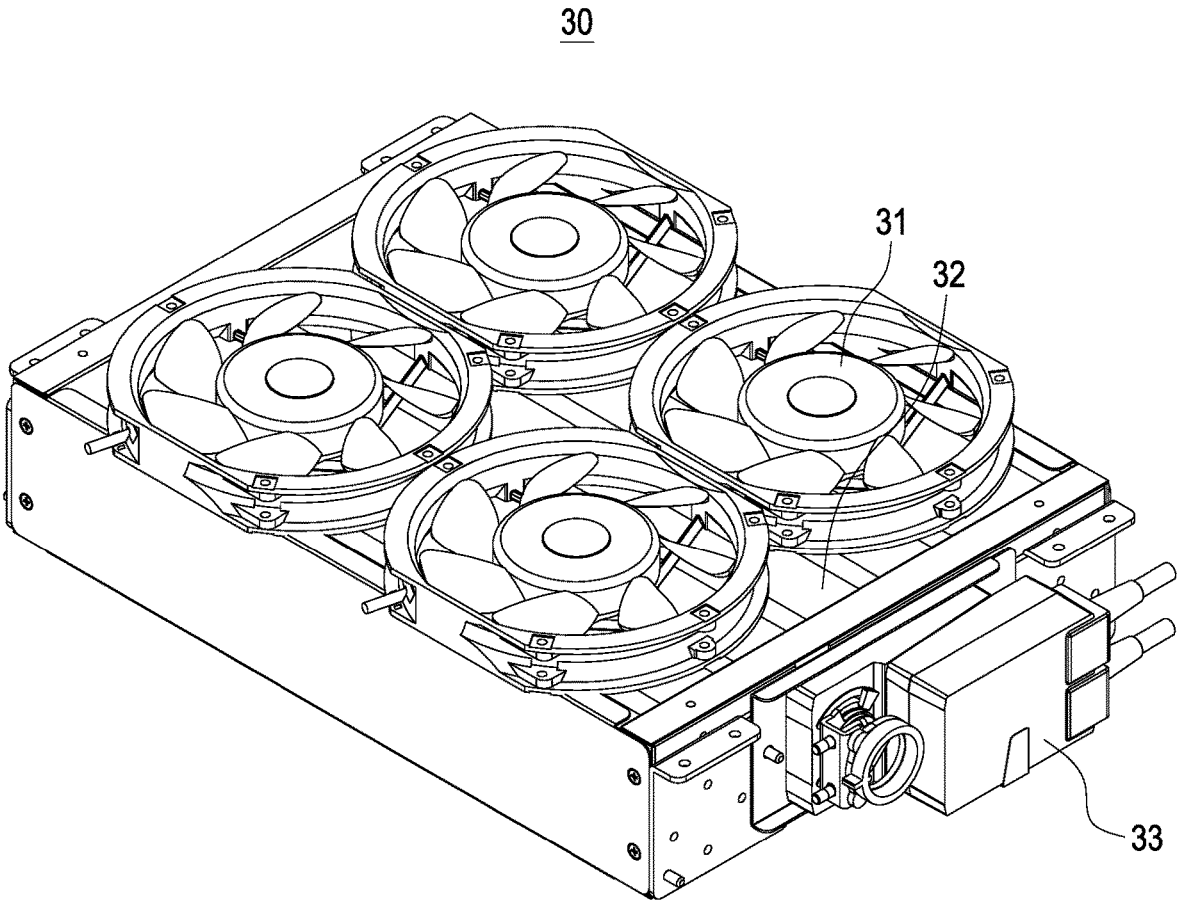
FIG. 4 and FIG. 5 are perspective schematic views of the first ventilation fan set in this disclosure.
Figure 5:
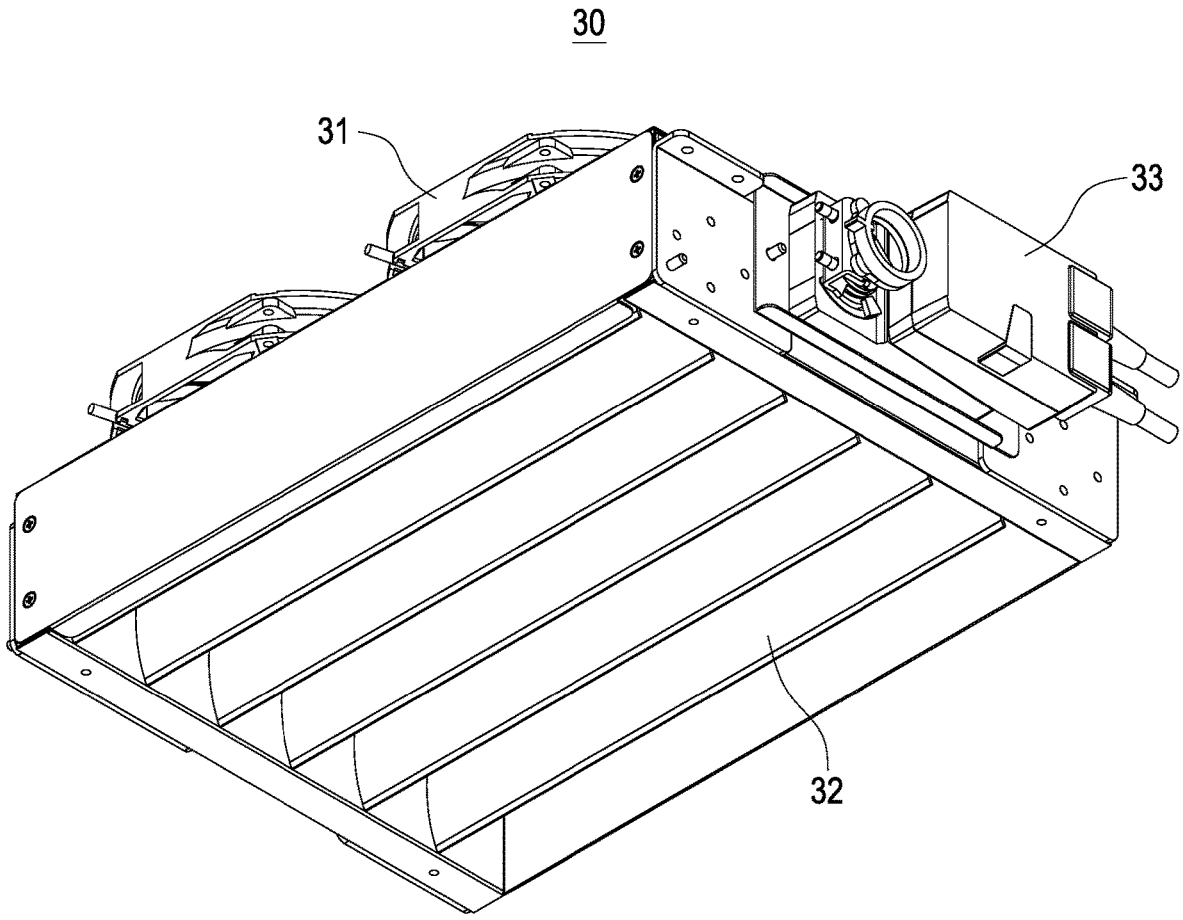

Please further refer to FIG. 4 and FIG. 5, which are perspective schematic views of the first ventilation fan set 30 in this disclosure. The first ventilation fan set 30 includes a first ventilation fan 31, a first valve 32 and a first valve switch 33. In this embodiment, the number of the first ventilation fan 31 is multiple. A plurality of first ventilation fans 31 are arranged in a matrix manner. The first valve 31 is combined on one side of the first ventilation fans 31. The first valve switch 33 controls the opening and closing of the first valves 32. In some embodiments, the operation of the first valve switch 33 may be performed through an automatic control.

It is worth noticing that, in one embodiment of this disclosure, the first ventilation fan set 30 further includes a first filter component 34. The first filter component 34 is combined on the side of the first valve 32 facing the inner air-conditioning fan 40 (also refer to FIG. 1) to filter the airflow entering the cabinet body 11 through the first valve 32.

Similarly, the second ventilation fan set 60 includes a second ventilation fan 61, a second valve and a second valve switch 63. In this embodiment, the number of second ventilation fan 61 is multiple. A plurality of second ventilation fans 61 are arranged in a matrix manner. The second valve 62 is combined on one side of the second ventilation fans 61. The second valve switch 63 controls the opening and closing of the second valves 62. In some embodiments, the operation of the second valve switch 63 may be performed through an automatic control.

Furthermore, the second ventilation fan set 60 further includes a second filter component 64. The second filter component 64 is combined on a side of the second valve 62 facing the outer air-conditioning fan 50 (also refer to FIG. 3) to filter the airflow entering the cabinet body 11 through the second valve 62.

Figure 6:
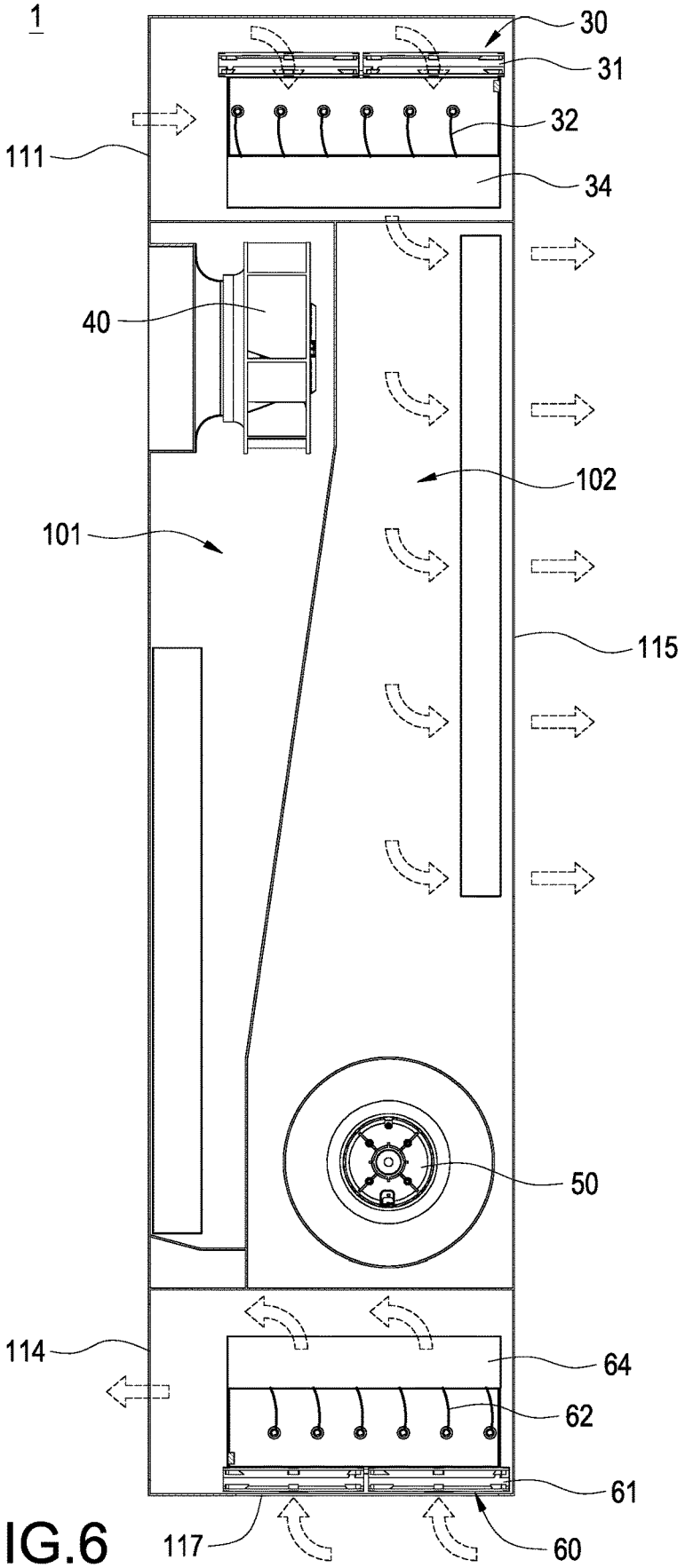
FIG. 6 is a schematic diagram of the airflow of the air conditioning and ventilating device during the operation of ventilation and energy-saving in this disclosure.

Please further refer to FIG. 6, which is a schematic diagram of the airflow of the air conditioning and ventilating device 1 during the operation of ventilation and energy-saving in this disclosure. When using the air-conditioning and ventilating device 1 of this disclosure, the inner chamber 101 of the cabinet body 11 faces the specific area that needs to be heat dissipated, such as a communication apparatus room, etc.

When the specific area needs to be ventilated only, the air conditioning unit 20 does not need to start, and the first ventilation fan set 30 is in the running state. Then, the air in the specific area flows into the first ventilation fan 31 from the inner ventilation inlet 111 and enters the outer chamber 102 through the first valve 32, and then flows out to the external environment through the outer air outlet 115.

In this embodiment, the air conditioning unit 20 is provided with a second ventilation fan set 60. The second ventilation fan set 60 works together with the first ventilation fan set 30. When the second ventilation fan set 60 is in operation, external air flows into the second ventilation fan 61 from the outer ventilation inlet 117 and passes through the second valve 62, and then flows into the specific area from the inner ventilation outlet 114.

Accordingly, the air conditioning and ventilating device 1 ventilates the specific area through the first ventilation fan set 30 and the second ventilation fan set 60. Additionally, since the air-conditioning unit 20 is not running during the operation of ventilation, the air conditioning and ventilating device 1 may achieve the effect of energy saving.

Figure 7:
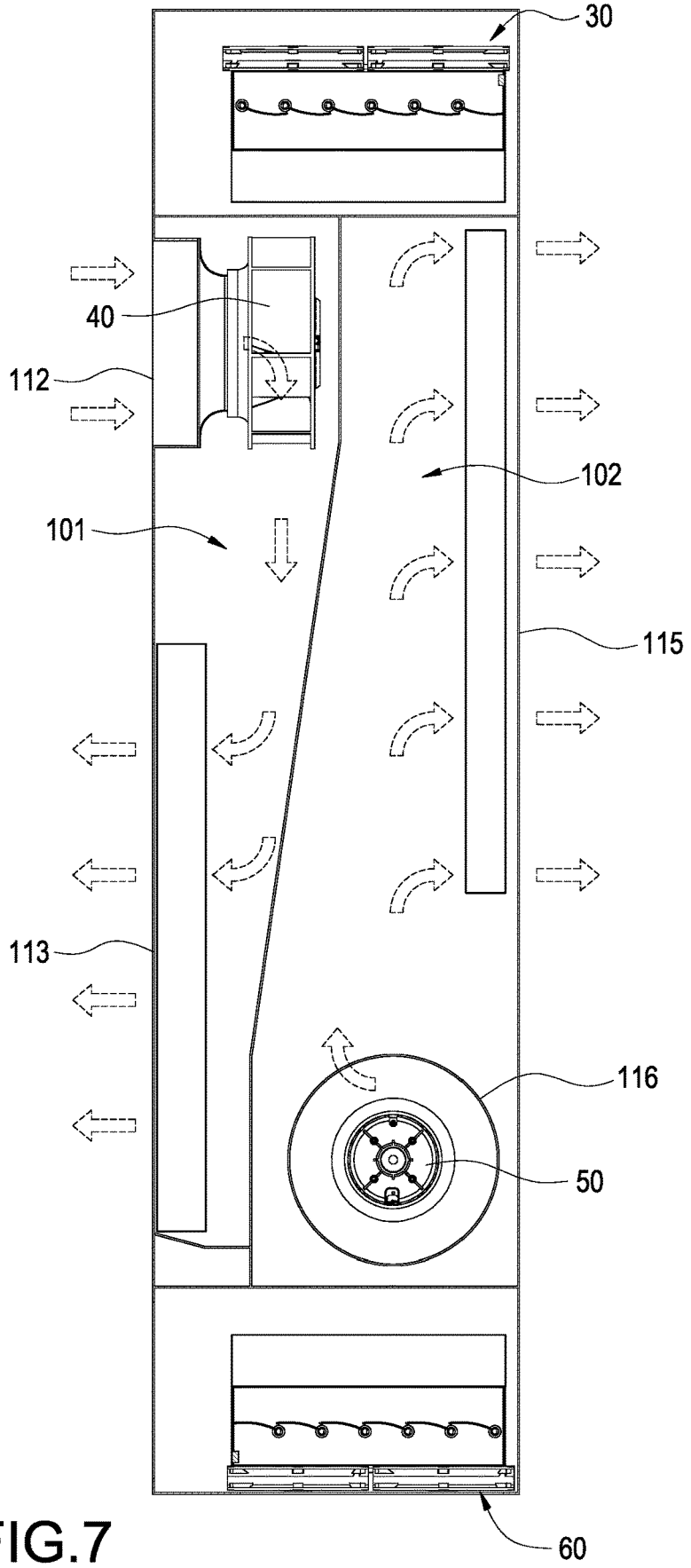
FIG. 7 is a schematic diagram of the airflow direction of the air conditioning and ventilating device during the operation of air conditioning in this disclosure.

Please further refer to FIG. 7, which is a schematic diagram of the airflow direction of the air conditioning and ventilating device 1 during the operation of air conditioning of this disclosure. The inner air-conditioning fan 40 and the outer air-conditioning fan 50 start running when the air conditioning is performed in the specific area, the air-conditioning unit 20. Then, the hot air in the specific area flows into the inner air-conditioning fan 40 from the inner air-conditioning inlet 112 and enters the inner chamber 101, and then passes through the air-conditioning unit 20 to form cooling air for heat exchange.

On the other hand, external air flows into the outer air-conditioning fan 50 from the outer air-conditioning inlet 116 and enters the outer chamber 102, and then passes through the air-conditioning unit 20 with heat through heat exchange, and then flows out to the outside environment from the outer air outlet 115.

Therefore, the cool air flowing out from the air-conditioning unit 20 flows into the specific area from the inner air-conditioning outlet 113 to dissipate heat in the specific area.

While this disclosure has been described by means of specific embodiments, numerous modifications and variations could be made thereto by those skilled in the art without departing from the scope and spirit of this disclosure set forth in the claims.

What is claimed is:

1. An air conditioning and ventilating device, comprising:

a cabinet, comprising a cabinet body and a partition, the cabinet body comprising an accommodating space, the accommodating space divided to an inner chamber and an outer chamber by the partition, the cabinet body comprising an inner ventilation inlet, an inner air-conditioning inlet, an inner air-conditioning outlet and an inner ventilation outlet all communicating with the inner chamber, and the cabinet body comprising an outer air outlet and an outer air-conditioning inlet both communicating with the outer chamber;

an air conditioning unit, installed in the cabinet body;

a first ventilation fan set, arranged in the accommodating space and communicating with the inner ventilation inlet and the outer air outlet;

an inner air-conditioning fan, arranged in the inner chamber and communicating with the inner air-conditioning inlet and the inner air-conditioning outlet;

an outer air-conditioning fan, arranged in the outer chamber and communicating with the outer air-conditioning inlet and the outer air outlet; and a second ventilation fan set and an outer ventilation inlet, wherein the second ventilation fan set is arranged on a bottom of the cabinet body; the inner ventilation outlet and the outer ventilation inlet are arranged on two sides of the bottom of the cabinet body; and the outer air-conditioning fan is located above the second ventilation fan set.

2. The air conditioning and ventilating device according to claim 1, wherein the first ventilation fan set and the inner ventilation inlet are arranged on a top of the cabinet body, and the inner air-conditioning fan is located below the first ventilation fan set.

3. The air conditioning and ventilating device according to claim 1, wherein the first ventilation fan set comprises a first ventilation fan and a first valve, and the first valve is combined on one side of the first ventilation fan.

4. The air conditioning and ventilating device according to claim 3, wherein the first ventilation fan set further comprises a first filter component, and the first filter component is combined on a side of the first valve facing the inner air-conditioning fan.

5. The air conditioning and ventilating device according to claim 1, wherein the second ventilation fan set comprises a second ventilation fan and a second valve, and the second valve is combined on one side of the second ventilation fan.

6. The air conditioning and ventilating device according to claim 5, wherein the second ventilation fan set further comprises a second filter component, and the second filter component is combined on a side of the second valve facing the outer air-conditioning fan.

7. The air conditioning and ventilating device according to claim 1, wherein the inner air-conditioning inlet is disposed below the inner ventilation inlet.

8. The air conditioning and ventilating device according to claim 1, wherein the inner air-conditioning outlet is arranged between the inner air-conditioning inlet and the inner ventilation outlet.

9. The air conditioning and ventilating device according to claim 1, wherein the outer air-conditioning inlet is arranged between the inner ventilation outlet and the inner air-conditioning outlet.

* * * * *